United States Patent [19]

Bennett

[11] 4,271,981

[45] Jun. 9, 1981

[54] GASOLINE PUMP CONSTRUCTION

[75] Inventor: James T. Bennett, Hartford, Wis.

[73] Assignee: Uni-Pump, Inc., Butler, Wis.

[21] Appl. No.: 50,680

[22] Filed: Jun. 21, 1979

[51] Int. Cl.[3] ..... B67D 5/26

[52] U.S. Cl. ..... 222/32

[58] Field of Search ..... 222/32, 33, 34, 35, 222/23

[56] References Cited

U.S. PATENT DOCUMENTS

| | | | |
|---|---|---|---|
| 3,045,868 | 7/1962 | Carnagua et al. | 222/34 X |
| 3,216,659 | 11/1965 | Ambler et al. | 222/35 X |
| 3,383,016 | 5/1968 | Ambler et al. | 222/33 |
| 3,523,642 | 8/1970 | Manke | 222/33 X |

*Primary Examiner*—Allen N. Knowles

*Attorney, Agent, or Firm*—Andrus, Sceales, Starke & Sawall

[57] ABSTRACT

A mechanism for converting a two-lever gasoline dispensing pump to a single lever system. The converted single lever unit includes a frame having an upper inverted U-shaped frame section and a pair of volume and cost registers are mounted in side-by-side relation within the upper frame section. A reset mechanism is operably connected to each register and the reset mechanisms are located at opposite sides of the frame. Each reset mechanism includes a shaft and the original operating handle located on the outside of the pump is carried by a second shaft which is off-set from the reset shaft and is connected to the reset shaft through a gear drive. When the hose nozzle is removed, the operating handle can be rotated to reset or clear the register and activate the fuel valve and pump. When dispensing has been completed, rotation of the handle to its original position will deactivate the fuel valve and pump, but the register will not be cleared until a subsequent resetting cycle is accomplished.

1 Claim, 4 Drawing Figures

Fig. 3
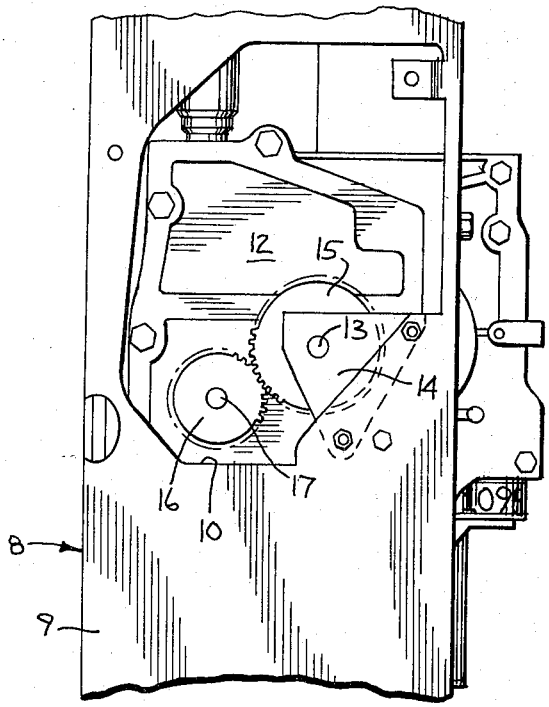
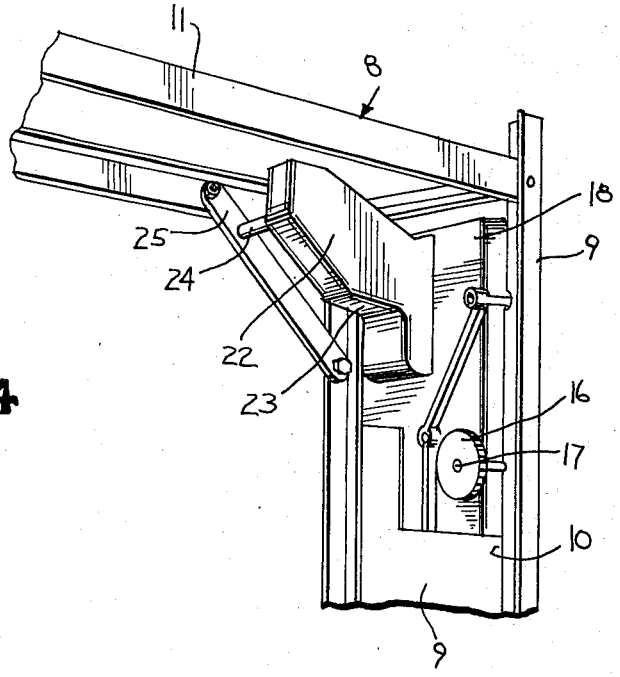
Fig. 4

GASOLINE PUMP CONSTRUCTION

BACKGROUND OF THE INVENTION

In the past, many gasoline dispensing pumps were provided with two operating levers. One lever was used to clear the volume and cost register and the second lever was utilized to activate the fuel valve and pump for a subsequent dispensing operation. With the advent of self-service stations, the two lever system was confusing to the purchaser, so that it was desirable to convert the two lever system to a single lever mechanism.

In addition, the two lever system provided a problem in self-service stations in that after dispensing the gasoline, the purchaser could rotate the "clear" lever which would clear the register, so that the station operator would have no indication as to the amount of gasoline which had been dispensed. In some situations the purchaser would purposely clear the register and attempt to pay for a lesser amount of gasoline than that actually dispensed.

The U.S. Pat. No. 3,216,659 to Ambler et al, is directed to a reset control mechanism to be associated with the register of a gasoline dispensing pump. In the structure of this patent, the reset mechanism is operably connected to the register, and a single operating handle located on the outside of the pump is connected to the shaft of the reset mechanism. When the hose nozzle is removed in order to dispense gasoline, the operating handle is rotated to clear or reset the register and to activate the fuel valve and fuel pump. After the delivery is complete and prior to restoring the hose nozzle in the receptacle on the pump, the manual control handle is rotated back to its original position which acts to deenergize the fuel valve and fuel pump. Thus, with the reset mechanism as described in the aforementioned patent, the register will not be cleared until a subsequent fuel delivery is to be made and the hose nozzle is removed and the control handle is rotated to the "ON" position.

SUMMARY OF THE INVENTION

The present invention is directed to a mechanism for converting a two-lever gasoline dispensing pump to a single lever system, utilizing a reset mechism, such as that described in U.S. Pat. No. 3,216,659. The converted single lever unit includes a supporting structure or frame having an upper inverted U-shaped frame section, and a pair of volume and cost registers are mounted in side-by-side relation within the upper frame section.

A reset control mechanism of the type described in U.S. Pat. No. 3,216,659 is operably connected to each register and the reset mechanisms are located at opposite sides of the frame. Each reset control mechanism includes a shaft, and an operating handle which is located on the outside of the pump, is mounted on a second shaft that is offset from the reset mechanism shaft and is connected to the reset mechanism shaft by a gear drive.

With this construction, removal of the hose nozzle from the receptacle of the pump and rotation of the operating handle to the "ON" position will activate the fuel pump and the valve, as well as clearing or resetting the register. Following the completion of dispensing, the operating handle is rotated back to its original "OFF" position which serves to deactivate the fuel valve and pump, but the register will not be cleared so that the station operator can see the amount and cost of the gasoline which has been dispensed.

The invention has particular application for conversion of two-lever gasoline dispensing pumps that contain a pair of volume and cost registers in an outer cylindrical housing. The entire converted unit, including the reset control mechanisms, are contained within the original housing and the converted unit utilizes the original operating handle that was associated with the two-lever system.

Other objects and advantages will appear in the course of the following description.

DESCRIPTION OF THE DRAWINGS

The drawings illustrate the best mode presently contemplated of carrying out the invention.

In the drawings:

FIG. 3 is a view taken along line 3—3 of FIG. 2, with parts broken away in section; and FIG. 4 is a perspective view of the upper frame section with the registers removed and showing the base plate with the nozzle receptacle.

DESCRIPTION OF THE PREFERRED EMBODIMENT

Figure 1:
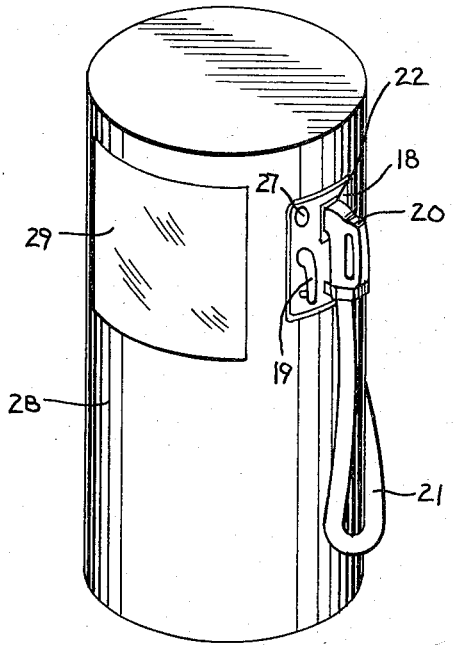
FIG. 1 is a perspective view of a gasoline dispensing pump which has been converted to a single lever system in accordance with the invention.
Figure 2:
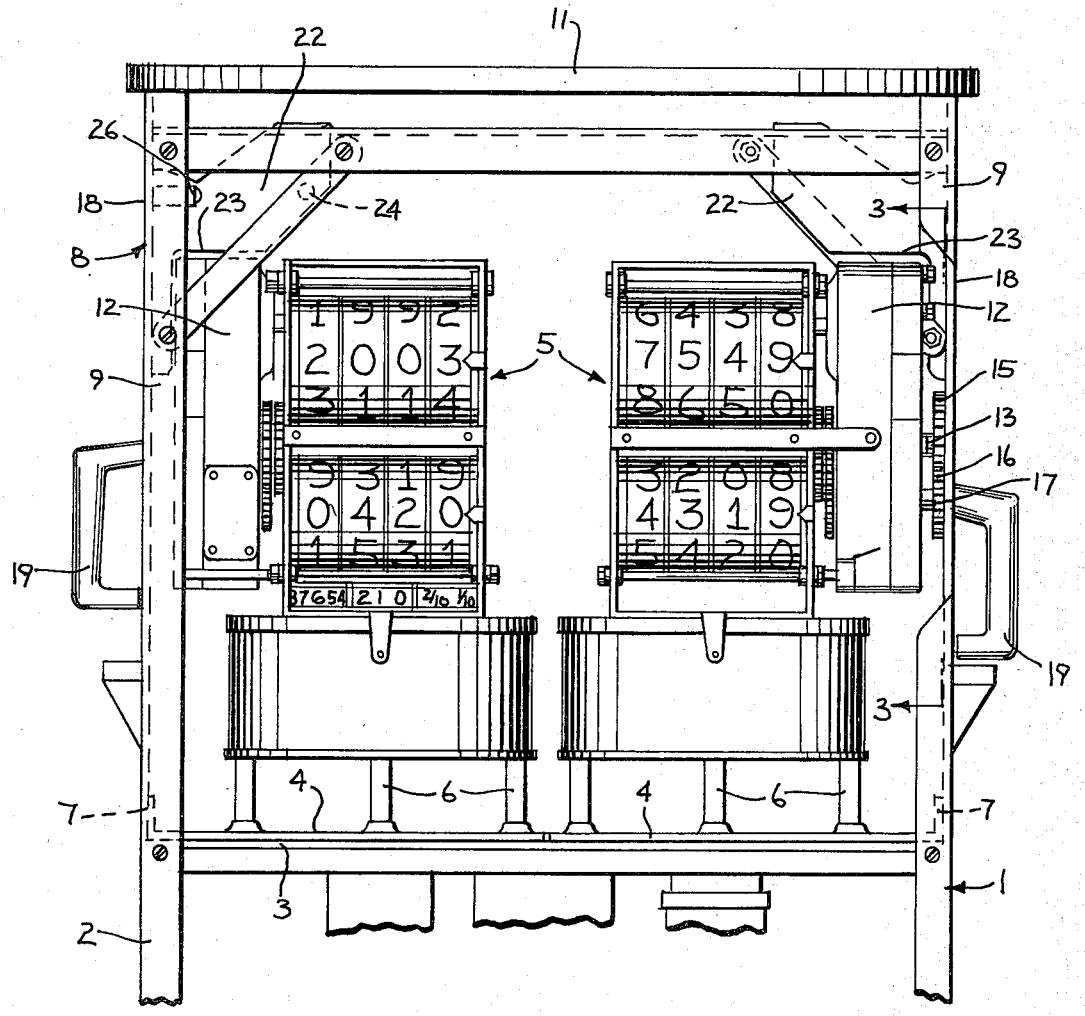
FIG. 2 is an enlarged fragmentary front elevation of the dispensing pump of FIG. 1 with the outer housing removed.

FIG. 1 illustrates a typical gasoline dispensing pump which originally was a two-lever system which has been converted through the invention to a single lever unit. The dispensing pump has a supporting structure or frame 1 which includes a lower frame section 2 and a central plate 3 which is mounted on the lower frame section.

In converting the original two-lever dispensing pump to a single lever system, a pair of adapter plates 4 are attached to the central plate 3, and a pair of conventional volume and cost registers 5 are mounted on the adapter plates 4 through a series of legs 6. In the original unit before modification, the registers 5 were mounted directly on the plate 3, but in making the conversion it is necessary to rotate each register 180° and thus the adapter plates 4 are utilized to accomplish this rotation of the registers 5.

Each adapter plate 4 is provided with an upstanding side flange 7 and an inverted U-shaped upper frame section 8 is connected to the flanges 7 and encloses the registers 5. As best shown in FIG. 4, the upper frame section 8 includes a pair of side members or legs 9, each of which is provided with an opening 10, and a top frame member 11 is connected between the side members 9.

A reset control mechanism 12 of the type desdribed in U.S. Pat. No. 3,216,659 is operably connected to each of the registers 5. The reset control mechanism in itself forms no part of the present invention.

Each reset mechanism 12 is provided with a control shaft 13, and the outer end of the shaft 13 is supported for rotation in a generally triangular plate 14 which is connected to the side member 9. Shaft 13 carries a gear 15 which is engaged with a gear 16 which is mounted on shaft 17 that extends outwardly through the opening in side member 9 and is journalled for rotation in the outer face plate 18. As best shown in FIG., the reset shaft 13 is offset from the shaft 17 and the gear drive provides an operable connection between the two shafts.

The outer end of each shaft 17 carries an operating handle 19. The operating handle 19 is movable between a generally vertical "OFF" position, as shown in FIG. 1, through approximately 120° to an "ON" position. As the operating handle 19 is adapted to rotate through approximately 120°, while the reset shaft rotates through 90°, the gear 16 on shaft 17 is smaller than the gear 15 on the reset shaft 13.

The dispenser includes a conventional dispensing nozzle 20 which is connected to a hose 21, and the nozzle 20 is retained within a receptacle or holder 22 which is secured within an opening in the outer face plate 18. The nozzle 20 must be removed from the receptacle 22 in order for the handle 19 to be moved from the "OFF" to the "ON" position and similarly, the handle must be returned to its original "OFF" position in order to insert the nozzle into the receptacle 22.

As the reset control mechanism 12 is located on the outer surface of the register, the reset mechanism would interfere with the conventional receptacle. Accordingly, the receptacle 22, is provided with a recess or notch 23 which accommodates the upper edge of the reset mechanism.

To attach the receptacle 22 to the upper frame section 8, the receptable is formed with a laterally extending threaded boss 24 and a bolt connects the boss to a diagonal brace 25 on the upper frame section 8. In addition, the receptacle is provided with a threaded boss 26, and a bolt is connected between the boss and the outer face plate 18.

As best shown in FIG. 1, the hole in the face plate which originally accommodated the second lever, which has been eliminated by the invention, can be enclosed by a plug 27.

The entire upper and lower frame sections are adapted to be enclosed by an outer, generally cylindrical housing or casing 28 and the upper portion of the housing is provided with a transparent window 29 so that the volume and cost registers 5 are visible.

To dispense gasoline, the nozzle 20 is removed from the receptacle 22, and the handle 19 is pivoted upwardly to the "ON" position. Pivoting of the handle operates through the gears 15 and 16 to actuate the reset control mechanism 12 to thereby activate the fuel valve and pump in the manner described in U.S. Pat. No. 3,216,659, as well as clearing or resetting the register 5. With the device thus conditioned, fuel can be dispensed.

After completion of the dispensing, the operating handle 19 is pivoted downwardly to the "OFF" position and the nozzle 20 is returned to the receptacle 22. Pivoting the operating handle to the "OFF" position operates through the gears 15 and 16 to operate the reset control mechanism 12 and deactivate the fuel valve and pump. However, the register is not reset or cleared so that the volume and cost remain on the counting wheels.

The invention enables a conventional two lever gas dispensing pump containing a pair of volume and cost registers to be readily converted to a single lever system with a minimum of cost. The entire converted unit is contained within the original housing, and the original facing plate and operating handle can be utilized.

Various modes of carrying out the invention are contemplated as being within the scope of the following claims particularly pointing out and distinctly claiming the subject matter which is regarded as the invention.

I claim:

1. In a fuel dispensing mechanism having a fuel pump and a fuel dispensing valve, a supporting structure, a pair of volume and cost registers disposed in side-by-side relation on the supporting structure, a reset control mechanism disposed outwardly of each register and having an operable connection to the respective register, each reset control mechanism being operable to clear the respective register and activate the fuel pump and dispensing valve, each reset control mechanism including a first control shaft disposed on the opposite side of the reset control mechanism from the register, a generally cylindrical housing to enclose the supporting structure and having a window to view the registers, said supporting structure having openings at opposite sides thereof, a face plate enclosing each opening, an operating handle disposed outwardly of each face plate, each operating handle being rotatable between a first "off" position and a second "on" position, a second shaft connected to each handle and journalled for rotation in said face plate, said second shaft being offset from the corresponding first shaft, a first gear on said first shaft and a second gear on said second shaft, said gears being in engagement whereby rotation of said handle will operate through said gears to rotate said first control shaft, each set of first and second gears being located in the space between the outer extremity of the corresponding reset mechanism and the face plate, each face plate having a receptacle for a hose nozzle, said operating handle being arranged such that the hose nozzle must be removed from the receptacle in order for the operating handle to be moved from the "off" to the "on" position, movement of the operating handle from the "off" position to the "on" position operating said reset control mechanism to clear the register and activate the fuel pump and dispensing valve so that fuel can be dispensed, and movement of the operating handle from said "on" position to said "off" position acting to deactivate the fuel pump and said dispensing valve.

* * * * *